US008769996B2

(12) United States Patent
Lonati et al.

(10) Patent No.: US 8,769,996 B2
(45) Date of Patent: Jul. 8, 2014

(54) DIAL OF CIRCULAR HOSIERY KNITTING MACHINE OF THE TYPE WITH CYLINDER AND DIAL WITH YARN CUTTING DEVICE

(75) Inventors: Ettore Lonati, Botticino (IT); Fausto Lonati, Brescia (IT); Tiberio Lonati, Brescia (IT)

(73) Assignee: Santoni S.p.A., Brescia (IT)

( * ) Notice: Subject to any disclaimer, the term of this patent is extended or adjusted under 35 U.S.C. 154(b) by 0 days.

(21) Appl. No.: 14/005,987

(22) PCT Filed: Mar. 14, 2012

(86) PCT No.: PCT/EP2012/054429

§ 371 (c)(1),
(2), (4) Date: Sep. 18, 2013

(87) PCT Pub. No.: WO2012/126778

PCT Pub. Date: Sep. 27, 2012

(65) Prior Publication Data

US 2014/0007625 A1 Jan. 9, 2014

(30) Foreign Application Priority Data

Mar. 18, 2011 (IT) ..... MI2011A0430

(51) Int. Cl.
*D04B 35/00* (2006.01)

(52) U.S. Cl.
USPC ..... 66/19; 66/142; 66/145 R

(58) Field of Classification Search
USPC ..... 66/8, 19, 145 R, 142, 145 S
See application file for complete search history.

(56) References Cited

U.S. PATENT DOCUMENTS

| | | | | | |
|---|---|---|---|---|---|
| 1,356,060 | A | * | 10/1920 | Fisher | 66/145 R |
| 3,081,609 | A | * | 3/1963 | Mahler | 66/134 |
| 3,521,466 | A | * | 7/1970 | Tannert | 66/19 |
| 3,640,094 | A | * | 2/1972 | Piana et al. | 66/19 |
| 3,890,809 | A | * | 6/1975 | Tenconi | 66/132 R |
| 4,099,392 | A | * | 7/1978 | Lonati | 66/140 R |
| 4,121,439 | A | * | 10/1978 | Wright | 66/140 R |

FOREIGN PATENT DOCUMENTS

| | | | |
|---|---|---|---|
| CH | 553 869 | A | 9/1974 |
| GB | 1000387 | A | 8/1965 |

OTHER PUBLICATIONS

International Search Report and Written Opinion dated Aug. 16, 2012 issued in PCT/EP2012/054429.

* cited by examiner

*Primary Examiner* — Danny Worrell
(74) *Attorney, Agent, or Firm* — Scully, Scott, Murphy & Presser, P.C.

(57) ABSTRACT

A dial of a circular hosiery knitting machine of the type with a cylinder and dial with yarn cutting device. The dial comprises a dial body which is substantially disk-shaped. The dial is provided with a cutting device, which comprises a plurality of cutting sectors which are distributed around the axis of the dial body and have cutting edges. The cutting sectors are arranged at sectors of the dial body which are intended to be free from needles. The cutting device comprises a cutter which is adapted to abut against the cutting edges of the cutting sectors to cut at least one yarn engaged by one of the cutting sectors in its rotary motion about the axis of the dial body with respect to the cutter.

10 Claims, 6 Drawing Sheets

DIAL OF CIRCULAR HOSIERY KNITTING MACHINE OF THE TYPE WITH CYLINDER AND DIAL WITH YARN CUTTING DEVICE

The present invention relates to a dial of a circular hosiery knitting machine of the type with cylinder and dial with yarn cutting device.

As is known, circular hosiery knitting machines with needle cylinder and dial comprise a supporting structure which supports a needle cylinder with a vertical axis which can be actuated with a rotary motion about such axis with respect to the supporting structure. On the lateral surface of the needle cylinder a plurality of axial slots is provided, inside each of which a needle is accommodated which can be actuated with an alternating motion along the corresponding axial slot in order to produce knitting.

Above the needle cylinder a dial is coaxially provided, which has a substantially disk-like body, on the upper face of which a plurality of radial slots is defined. Generally, each one of the radial slots accommodates a corresponding needle, which can be actuated with an alternating motion along the corresponding radial slot in order to produce knitting or cooperate with the needles of the needle cylinder in the production of knitting.

Such machines are provided with cutting devices in order to cut the yarns at the end of their use by the needles in forming the knitting. Such cutting devices generally comprise a disk-like blade, also known as knife, which is fixed above and coaxially with respect to the body of the dial. The knife has, at its peripheral edge, a plurality of teeth, each provided with a cutting edge which is oriented substantially radially with respect to the axis of the knife. The teeth are arranged proximate to the peripheral edge of the body of the dial, above the needles accommodated in the radial slots of the dial body so as to engage the yarn or yarns at the end of their use by the needles during the formation of the knitting.

The cutting devices, in addition to the above mentioned knife, comprise at least one cutter which is arranged above the knife and rests with its cutting edge against the region of the knife that is occupied by the teeth. The knife is rigidly coupled to the dial and therefore to the needle cylinder in rotation about its own axis, while the cutter is connected to the supporting structure of the machine.

In practice, when the use of a yarn in the formation of knitting by a group of needles ends, the yarn guide that supplies the yarn is moved away from the working region of the needles, generally by lifting the yarn guide with respect to the needle cylinder. In this manner, a portion of the yarn runs from the last needle that engaged it to the corresponding yarn guide, arranging itself along a chord above the knife, which, by rotating about its own axis, engages with one of its teeth this portion of yarn and draws it against the cutting edge of the cutter, which, by acting as a contrast blade, cuts the yarn.

This cutting operation leaves on the article being formed a tail of yarn whose length is equal to the distance between the last needle that picked up the yarn and the tooth of the knife that engaged it at the end of its use by the needle.

The presence of the yarn tail is unwanted, since it constitutes an aesthetically displeasing note on the finished article and is a waste of yarn.

This problem is felt particularly in the production of high or medium-high quality articles, in which the user pays particular attention to the finish of the articles and for which, during production, an attempt is made to reduce as much as possible production waste, since they are made with high-value yarns.

The problem of reducing the length of the tail of yarn in circular hosiery knitting machines with cylinder and dial is not simple to solve, since the distance between the plane of arrangement of the knife and the bottom of the radial slots cannot drop below a certain limit in order to avoid interference between the knife and the needles arranged in the radial slots of the dial.

The aim of the present invention is to solve the above mentioned problem, by providing a dial of a circular hosiery knitting machine of the type with cylinder and dial with yarn cutting device that makes it possible to reduce the length of the tail of yarn that derives from its cutting by the cutting device.

Within this aim, an object of the invention is to provide a dial with a cutting device that offers the greatest assurances of safety and reliability in use.

Another object of the invention is to provide a dial with a cutting device that can be manufactured with competitive costs.

This aim, as well as these and other objects that will become better apparent hereinafter, are achieved by a dial of a circular hosiery knitting machine of the type with cylinder and dial with yarn cutting device, comprising a dial body which is substantially disk-shaped and can be arranged above and coaxially with respect to the needle cylinder with a vertical axis of a circular hosiery knitting machine, on the upper face of said dial body a plurality of radial slots being provided which are adapted to accommodate needles that can be actuated along the corresponding radial slot to form knitting or to cooperate with the needles of the needle cylinder to form knitting, characterized in that it is provided with a cutting device, which comprises a plurality of cutting sectors which are distributed around the axis of said dial body and have cutting edges which are oriented substantially radially with respect to the axis of said dial body, said cutting sectors being arranged at sectors of said dial body which are intended to be free from needles, said cutting device further comprising a cutter which is adapted to abut against said cutting edges of the cutting sectors to cut at least one yarn engaged by one of said cutting sectors in its rotary motion about the axis of said dial body with respect to said cutter.

Further characteristics and advantages of the invention will become better apparent from the description of a preferred but not exclusive embodiment of the dial with cutting device according to the invention, illustrated by way of non-limiting example in the accompanying drawings, wherein.

Figure 1:
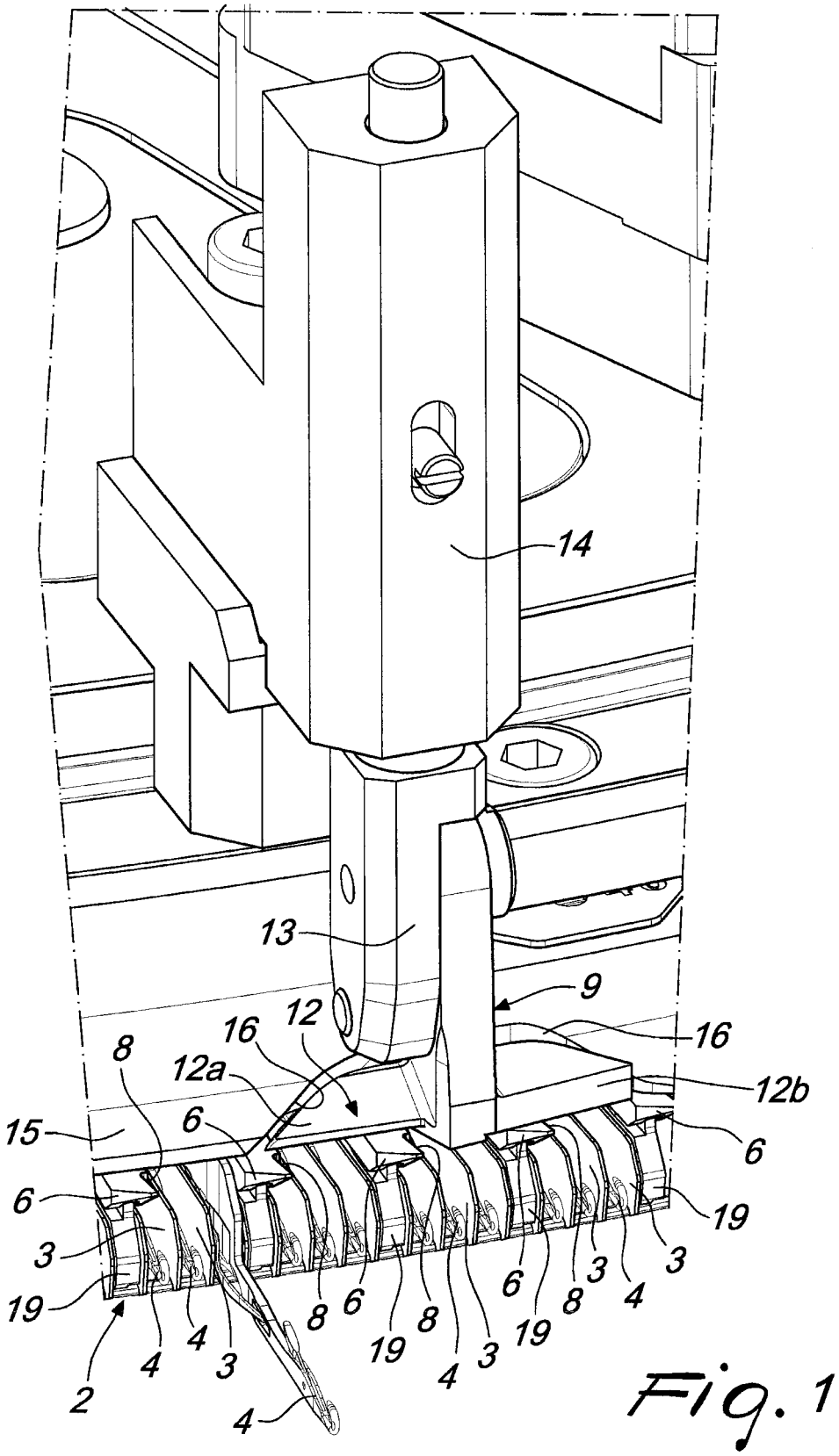
FIG. 1 is a perspective view of a portion of the dial with the cutting device according to the invention.
Figure 2:
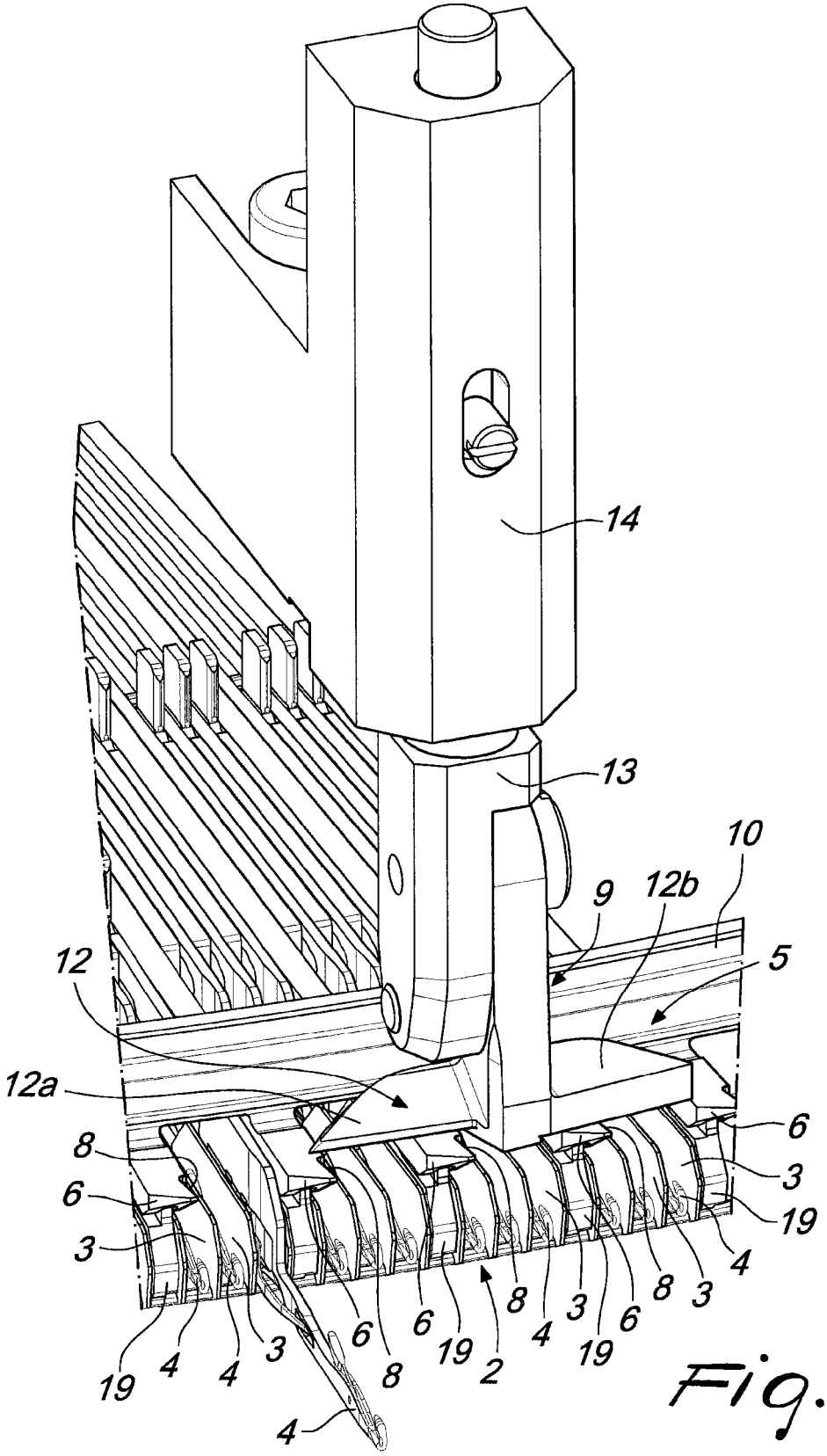
FIG. 2 is a perspective view of a portion of the dial with the cutting device according to the invention, with a protective element removed for greater clarity.

With reference to the figures, the dial of a circular hosiery knitting machine of the type with cylinder and dial with yarn cutting device, according to the invention, generally designated by the reference numeral 1, comprises a dial body 2, which has a substantially disk-like shape and which, like dials of the conventional type, can be arranged above and coaxially with respect to the needle cylinder, which has a vertical axis, of a circular hosiery knitting machine.

On the upper face of the dial body 2 a plurality of radial slots 3 is provided, which are adapted to accommodate needles 4 which can be actuated along the corresponding radial slot 3 in order to form knitting or cooperate with the needles of the needle cylinder to form knitting, in a per se known manner.

The cutting device according to the invention, generally designated by the reference numeral 5, comprises a plurality of cutting sectors 6, which are distributed around the axis 7 of the dial body 2 and have cutting edges 8 which are oriented substantially radially with respect to the axis 7 of the dial body 2. The cutting sectors 6 are arranged at sectors of the dial body 2 which are designed to be free from needles 4. The cutting device 5 further comprises a cutter 9 which is adapted to abut against the cutting edges 8 of the cutting sectors 6 in order to cut at least one yarn which is engaged by one of the cutting sectors 6 in the rotary motion of the cutting sectors 6 integrally with the dial body 2 about the axis 7 with respect to the cutter 9, as will become better apparent hereinafter.

Preferably, each one of the cutting sectors 6 is arranged at a radial slot 3 which is not used to accommodate any needle 4.

Conveniently, each one of the cutting sectors 6 is accommodated partially in one of the radial slots 3 of the dial body 2 that is free from needles.

More particularly, each one of the cutting sectors 6 is fixed to a corresponding supporting element 19, which rests on the bottom of a radial slot 3 which is free from needles, so that the cutting edges 8 of the cutting sectors 6 lie directly above the upper end of the side walls of the radial slots 3.

As an alternative, the supporting element 19 may be missing and each cutting sector 6 might be provided with such a thickness as to rest on the bottom of the corresponding radial slot 3.

In practice, in the dial 1 according to the invention, by utilizing the fact that for most of the knitting that can be performed with a circular hosiery knitting machine with needle cylinder and dial only a part of the needles 4 arranged in the dial 1 is used, and some radial slots 3, instead of accommodating a needle 4 which would remain practically unused, are used preferably to accommodate partially and/or support a corresponding cutting sector 6.

The replacement of the conventional knife, which has a continuous disk-like body, with a plurality of cutting sectors 6 which are partially accommodated and supported in radial slots 3 defined on the upper face of the dial body 2 makes it possible to arrange the cutting edges 8 of the cutting sectors 6 further downward with reference to the arrangement of the dial 1 on the machine, i.e., on a plane which is significantly closer to the bottom of the radial slots 3, and therefore closer to the needles 4 arranged in the dial 1, with respect to the plane of arrangement of the cutting edges of knives of the conventional type. The reduction of the distance of the cutting edges 8 from the bottom of the radial slots 3 is allowed by the fact that the cutting sectors 6 are arranged in sectors of the dial body 2 which are not occupied by needles 4 and therefore the danger of any interference with the needles 4 arranged in the dial 1 is excluded. The lowering of the plane of arrangement of the cutting edges 8 of the cutting sectors 6 causes the cutting edges 8 to be closer both to the needles 4 arranged in the dial 1 and to the needles arranged in the needle cylinder, thus making it possible to reduce the length of the tail of yarn that extends from the last needle that picked up the yarn and the cutting edge 8 of the cutting sector 6 that engages it and cuts it in cooperation with the cutter 9.

Preferably, the cutting sectors 6 are mutually joined, at their end directed toward the axis 7 of the dial body 2, by an annular element 10, which is coaxial to the dial body 2.

The cutter 9 is provided with a cutting edge 11 which is adapted to abut as a complementary blade against the cutting edge 8 of the cutting sectors 6. The cutter 9 is provided with a resting base 12, which can be engaged against the upper face of the cutting sectors 6, and the resting base 12 conveniently has an angular extension, relatively to the axis 7 of the dial body 2, at least equal to twice the angular distance between two contiguous cutting sectors 6.

Figure 7:
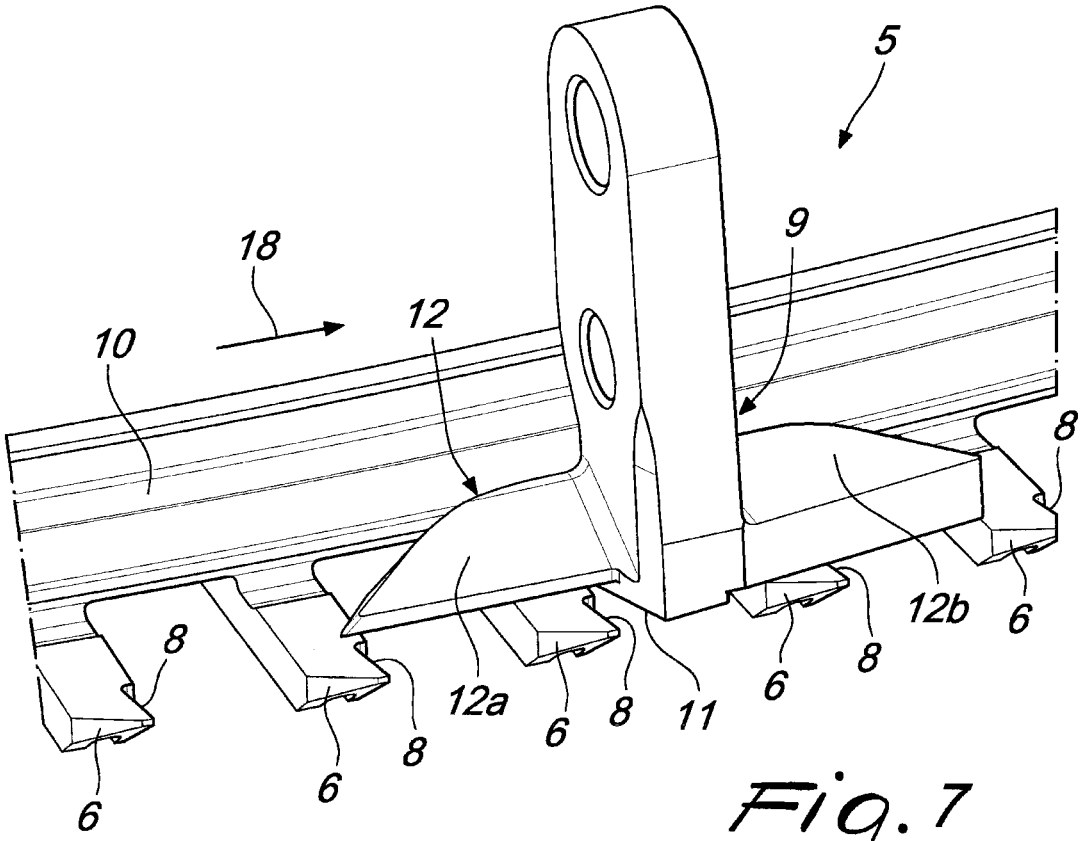
FIG. 7 is a perspective view of the cutting device as regards only some cutting sectors and the cutter.
Figure 6:
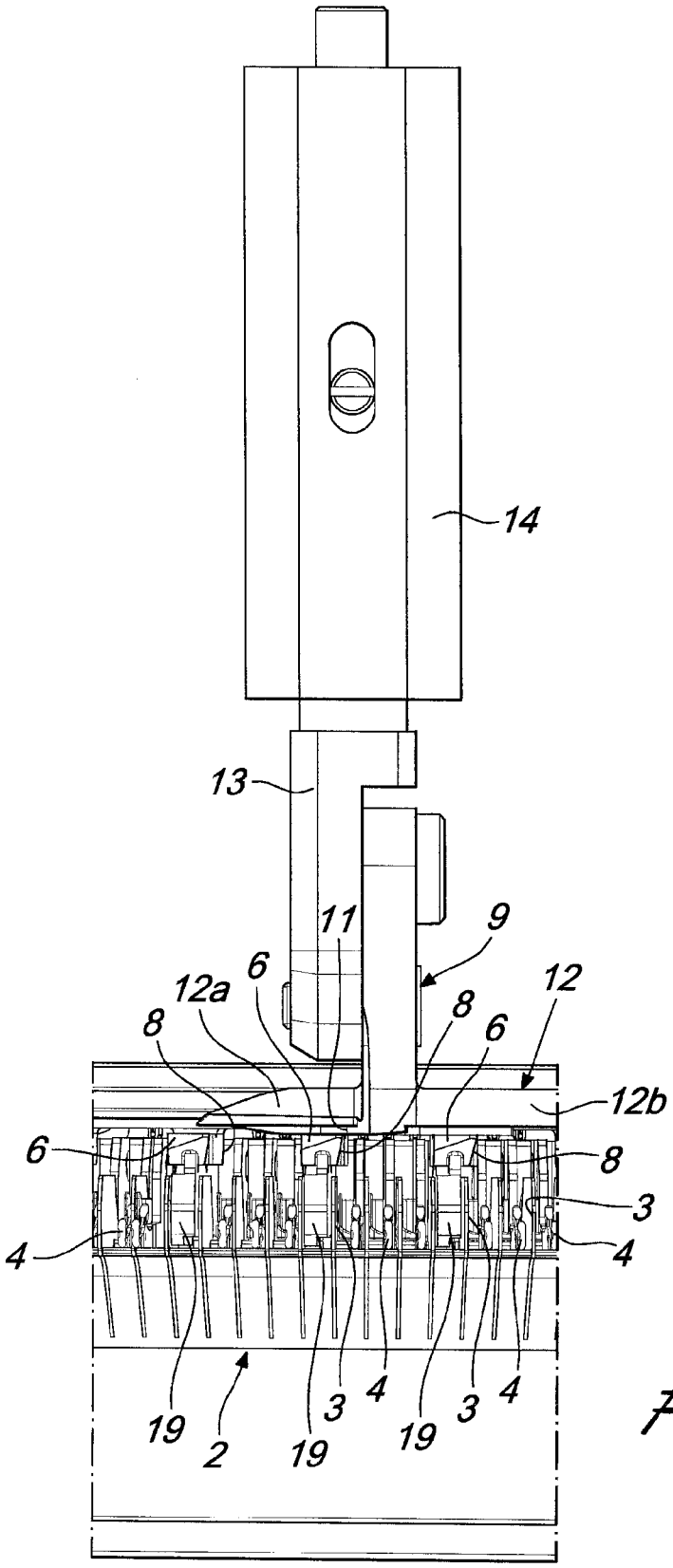
FIG. 6 is a front elevation view of a portion of the dial with the cutting device according to the invention.

Preferably, the resting base 12 has a portion 12*a* which lies upstream and a portion 12*b* which lies downstream of the cutting edge 11 of the cutter 9 according to the motion, indicated by the arrow 18 in FIG. 7, of the dial body 2 and therefore of the cutting sectors 6 about the axis 7 with respect to the cutter 9.

In this manner, despite the discontinuity that is present between the cutting sectors 6, the cutter 9 rests stably against at least two contiguous cutting sectors 6, obviating this discontinuity.

The cutter 9 is connected to a supporting block 13, which is arranged above the dial body 2 and is pushed, in a per se known manner, downward so as to ensure the resting of the cutter 9 against the upper face of the cutting sectors 6. The downward thrust can be provided by a spring, of a known type not shown for the sake of simplicity, which is accommodated in a box-like body 14 which supports, so that it can slide along an axis that is substantially perpendicular to the plane of arrangement of the dial body 2, the supporting block 13 to which the cutter 9 is connected.

It should be noted that in a per se known manner the cutter 9 can be connected rigidly to the supporting block 13, as shown, or so that it can rotate about an axis which is substantially perpendicular to a plane that passes through the axis 7 of the dial body 2, so as to be able to oscillate on a radial plane with respect to the dial 1 in order to adapt to any movements, on this plane, of the cutting sectors 6 during their rotation.

For the sake of completeness in description, it should be noted that some of the cutting sectors 6 and the annular element 10 are protected by a covering element 15, which also is annular and has, at the cutter 9, an adapted recess 16.

As in conventional machines, a plurality of cutters 9 can be provided which are distributed about the axis 7 of the dial 1 depending on the number of feeds or drops of the machine and according to the requirements.

Figure 3:
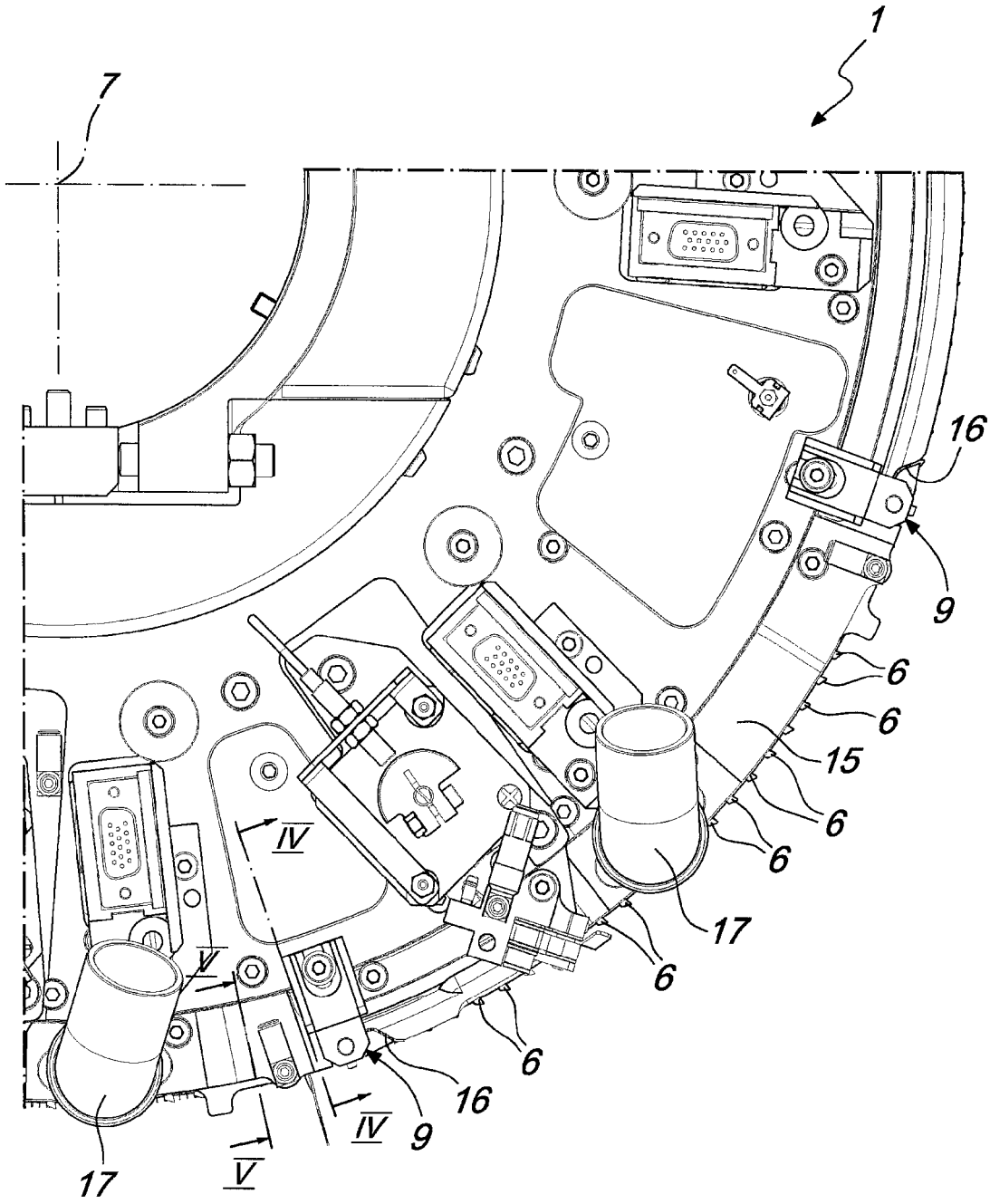
FIG. 3 is a top plan view of a portion of the dial with the cutting device according to the invention.
Figure 4:
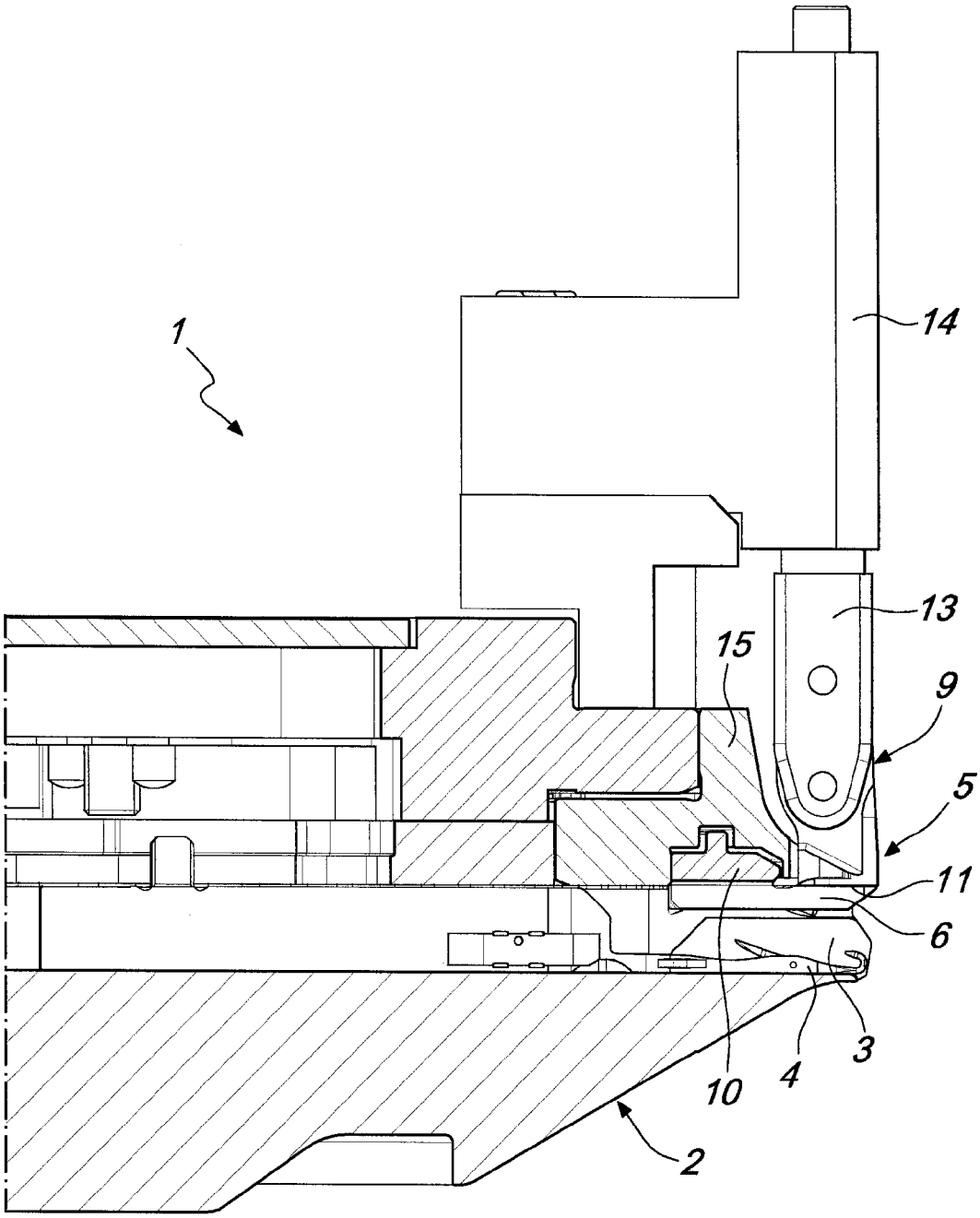
FIG. 4 is a sectional view of FIG. 3, taken along the line IV-IV.
Figure 5:
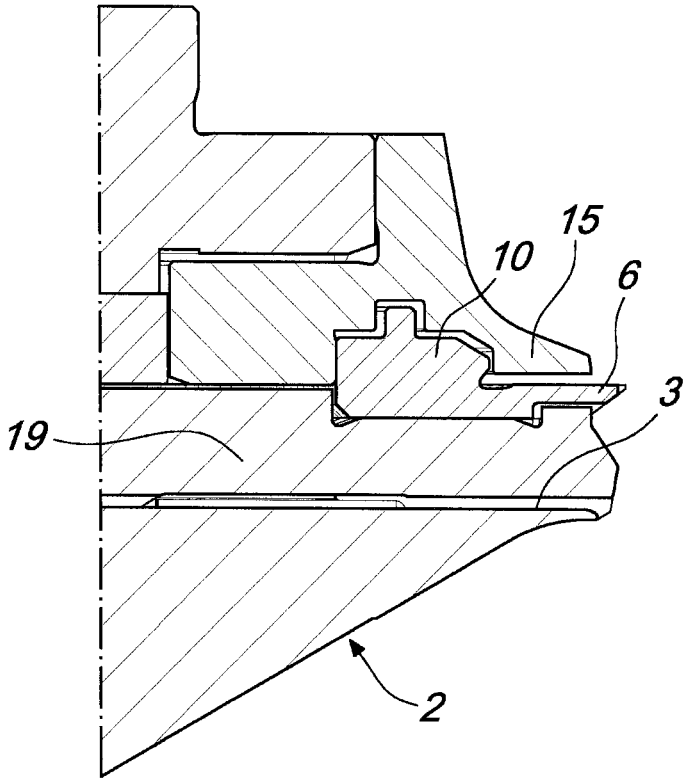
FIG. 5 is a sectional view of FIG. 3, taken along the line V-V.

FIG. 3 shows two cutters 9, which are mutually arranged angularly about the axis 7 of the dial body 2 and have been designated by the same reference numeral.

FIG. 3 shows other elements, such as for example intake ports 17 and other devices of a known type, which are not described in detail for the sake of simplicity.

Operation of the cutting device according to the invention is as follows.

When a needle 4 arranged in the dial 1 or in the needle cylinder stops knitting with a yarn, the yarn guide that feeds this yarn, like in circular hosiery knitting machines that use cutting devices of the known type, is raised so as to prevent the needles that follow the last needle that picked up the yarn from picking up the yarn. Due to this lifting and due to the rotation of the needle cylinder and of the dial 1 about the common axis 7 with respect to the yarn guide, the yarn arranges itself along a chord and is engaged by the cutting edge 8 of the cutting sector 6 that is arranged directly after the last needle that picked up the yarn according to the direction of rotation of the dial 1 and of the needle cylinder about the axis 7.

The cutting sector 6 draws the engaged yarn until it arrives at the cutter 9, which by acting as a contrast blade cuts the yarn.

In practice it has been found that the dial with cutting device according to the invention fully achieves the intended aim, since the replacement of the conventional knife with cutting sectors that are arranged in regions of the dial body that are not occupied by needles makes it possible to reduce the distance between the cutting edges that engage and cut the yarn and the last needle that picked up the yarn and therefore makes it possible to reduce the length of the tail of yarn that remains on the manufactured article after cutting, making it possible to save yarn and improving the quality of the manufactured articles.

The dial with cutting device thus conceived is susceptible of numerous modifications and variations, all of which are within the scope of the appended claims; all the details may further be replaced with other technically equivalent elements.

In practice, the materials used, as well as the dimensions, may be any according to requirements and to the state of the art.

The disclosures in Italian Patent Application No. MI2011A000430 from which this application claims priority are incorporated herein by reference.

The invention claimed is:

1. A dial of a circular hosiery knitting machine of the type with a cylinder and dial with yarn cutting device, comprising a dial body which is substantially disk-shaped and can be arranged above and coaxially with respect to the needle cylinder with a vertical axis of a circular hosiery knitting machine, on the upper face of said dial body a plurality of radial slots being provided which are adapted to accommodate needles that can be actuated along the corresponding radial slot to form knitting or to cooperate with the needles of the needle cylinder to form knitting, further comprising a cutting device, which comprises a plurality of cutting sectors which are distributed around the axis of said dial body and have cutting edges which are oriented substantially radially with respect to the axis of said dial body, said cutting sectors being arranged at sectors of said dial body which are intended to be free from needles, said cutting device further comprising a cutter which is adapted to abut against said cutting edges of the cutting sectors to cut at least one yarn engaged by one of said cutting sectors in its rotary motion about the axis of said dial body with respect to said cutter.

2. The dial according to claim 1, wherein each one of said cutting sectors is arranged at one of said radial slots that is intended not to contain needles.

3. The dial according to claim 2, wherein each one of said cutting sectors is partially accommodated in one of said radial slots of the dial body that is intended not to contain needles.

4. The dial according to claim 2, wherein each one of said cutting sectors is fixed to a supporting element, which is accommodated in one of said radial slots of the dial body that is intended not to contain needles.

5. The dial according to claim 1, wherein said cutting sectors are mutually joined, at their end directed toward the axis of said dial body, by an annular element which is coaxial to said dial body.

6. The dial according to claim 1, wherein said cutter has a cutting edge which is adapted to abut as a contrast blade against the cutting edge of said cutting sectors, said cutter being provided with a resting base that can engage against an upper face of said cutting sectors.

7. The dial according to claim 6, wherein said resting base has an angular extension, referred to the axis of said dial body, which is equal to at least twice an angular distance between two contiguous said cutting sectors.

8. The dial according to claim 6, wherein said resting base has a portion upstream and a portion downstream of the cutting edge of said cutter along the motion of said dial body about its own axis with respect to said cutter.

9. The dial according to claim 5, wherein part of said cutting sectors and said annular element are protected by an annular covering element.

10. The dial according to claim 9, wherein said covering element has a recess at said cutter.

* * * * *